US008523616B2

(12) United States Patent
Pan

(10) Patent No.: US 8,523,616 B2
(45) Date of Patent: Sep. 3, 2013

(54) ELECTRICAL CONNECTOR INCLUDING CONTACTS AND HOUSING RECESSES AND AIR POCKETS FOR IMPROVED IMPEDANCE

(75) Inventor: Feng Pan, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 25 days.

(21) Appl. No.: 13/402,052

(22) Filed: Feb. 22, 2012

(65) Prior Publication Data

US 2012/0220170 A1 Aug. 30, 2012

(51) Int. Cl.
*H01R 24/00* (2011.01)

(52) U.S. Cl.
USPC ..... 439/660

(58) Field of Classification Search
USPC ..... 439/660, 637, 66, 79, 482, 587, 607.01, 439/607.34, 607.05; 324/754, 761; 174/65 R
See application file for complete search history.

(56) References Cited

U.S. PATENT DOCUMENTS 5,046,960 A * 9/1991 Fedder ..... 439/108
5,496,183 A * 3/1996 Soes et al. ..... 439/79
5,637,012 A * 6/1997 Ott ..... 439/482
6,617,512 B2 * 9/2003 Roques ..... 174/663
6,669,514 B2 * 12/2003 Wiebking et al. ..... 439/701
6,768,327 B2 * 7/2004 Felici et al. ..... 324/755.06
6,939,173 B1 * 9/2005 Elco et al. ..... 439/607.34
6,976,886 B2 12/2005 Winings et al.
6,981,883 B2 1/2006 Raistrick et al.
7,074,086 B2 7/2006 Cohen et al.
7,118,381 B2 * 10/2006 Weidner ..... 439/63
7,585,188 B2 * 9/2009 Regnier ..... 439/637
7,651,373 B2 * 1/2010 Knaub et al. ..... 439/607.05
7,806,698 B2 * 10/2010 Regnier ..... 439/37
7,819,703 B1 * 10/2010 Walker et al. ..... 439/676
7,980,896 B1 * 7/2011 Morgan ..... 439/607.05
8,187,035 B2 * 5/2012 Davis et al. ..... 439/607.02
8,231,411 B1 * 7/2012 Westman et al. ..... 439/607.05
8,262,412 B1 * 9/2012 Minnick et al. ..... 439/607.01
8,292,629 B2 * 10/2012 McAlonis et al. ..... 439/65
8,313,354 B2 * 11/2012 McAlonis et al. ..... 439/884

* cited by examiner

*Primary Examiner* — Alexander Gilman
(74) *Attorney, Agent, or Firm* — Ming Chieh Chang; Wei Te Chung

(57) ABSTRACT

An electrical connector (100) includes a housing having a securing structure and a number of contacts (30). The securing structure defines a number of passageways (40) each extending therethrough along a thickness direction thereof, a number of securing recesses (42) each across and in communication with a corresponding passageway along a width direction thereof, and a number of air pockets (41) each across and in alignment with a corresponding passageway along a length direction thereof. Each contact has a body portion (32) inserted through the passageway, and a widen portion (31) secured in the securing recess and facing a corresponding air pocket.

20 Claims, 7 Drawing Sheets

ELECTRICAL CONNECTOR INCLUDING CONTACTS AND HOUSING RECESSES AND AIR POCKETS FOR IMPROVED IMPEDANCE

BACKGROUND OF THE INVENTION

1. Field of the Invention

The present invention relates to an electrical connector, and more particularly to a high speed, high density backplane connector.

2. Description of Related Art

U.S. Pat. No. 7,074,086 issued to Cohen et al. on Jul. 11, 2006 discloses a high speed backplane connector. The backplane connector includes a housing, a plurality of signal contacts and grounding contacts secured in the housing. The housing includes a bottom wall, a pair of side walls rising from opposite edges of the bottom wall. The bottom wall defines a plurality of passageways for insertion of the signal contacts and the grounding contacts.

U.S. Pat. No. 6,976,886 issued to Winings et al. on Dec. 20, 2005 discloses a high speed backplane connector. The connector includes a housing defining a plurality of recesses and a plurality of contacts inserted into the recesses. Each contact has a pair of shoulders for being reliably secured in the recesses.

U.S. Pat. No. 6,669,514 issued to Wiebking et al. on Dec. 30, 2003 discloses a connector including a plurality of contact modules. Each contact module has a frame and a plurality of contacts integrated with the frame. Each frame defines a plurality of air pockets for improving the impedance of the contacts. U.S. Pat. No. 6,981,883 issued to Raistrick et al. on Jan. 3, 2006 discloses a connector including a plurality of contact modules. Each contact module has a frame and a plurality of contacts secured on the frame. Two contact modules have a plurality of air pockets between the contact of one contact frame and the contact of another contact frame.

An electrical connector including contacts having improved impedance is desired.

SUMMARY OF THE INVENTION

Accordingly, an object of the present invention is to provide an electrical connector including a housing defining air pockets, and a plurality of contacts facing the air pockets to obtain improved characteristic impedance.

In order to achieve the object set forth, an electrical connector includes a housing having a securing structure and a number of contacts. The securing structure defines a number of passageways each extending therethrough along a thickness direction thereof, a number of securing recesses each across and in communication with a corresponding passageway along a width direction thereof, and a number of air pockets each across and in alignment with a corresponding passageway along a length direction thereof. Each contact has a body portion inserted through the passageway, and a widen portion secured in the securing recess and facing a corresponding air pocket.

The contact is secured in the securing recess via the widen portion and has an impedance thereof improved by air in the air pocket.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
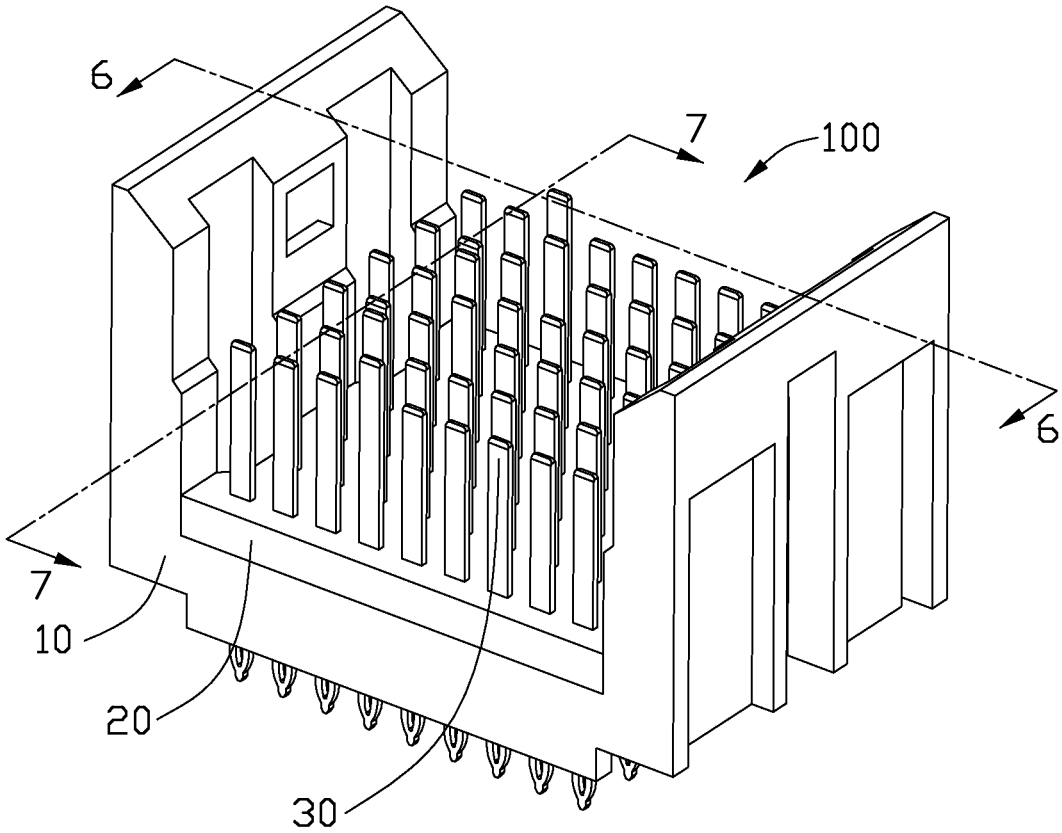
FIG. 1 is an assembled perspective view showing an electrical connector in accordance with the present invention.
Figure 2:
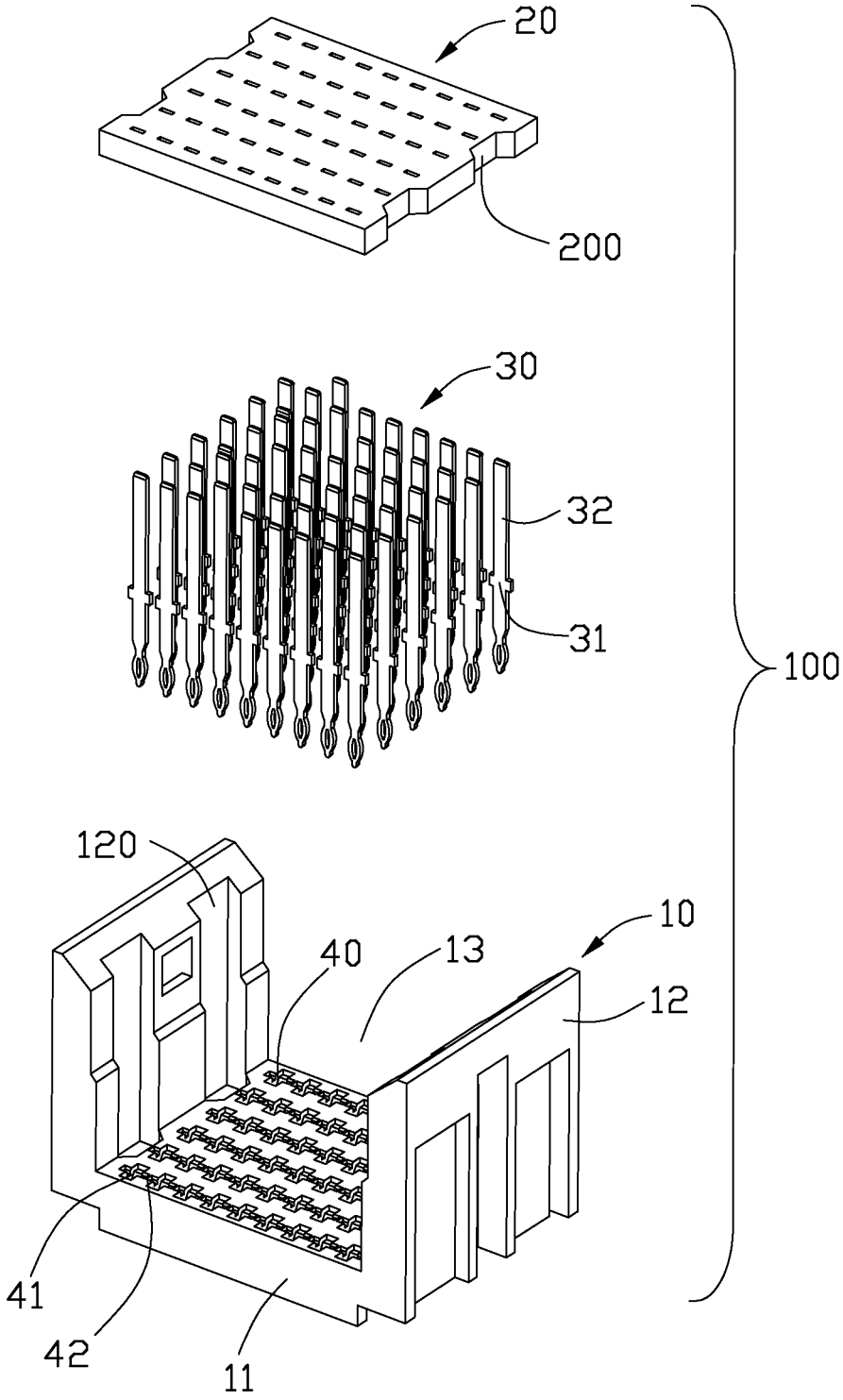
FIG. 2 is an exploded perspective view showing the electrical connector shown in FIG. 1.
Figure 3:
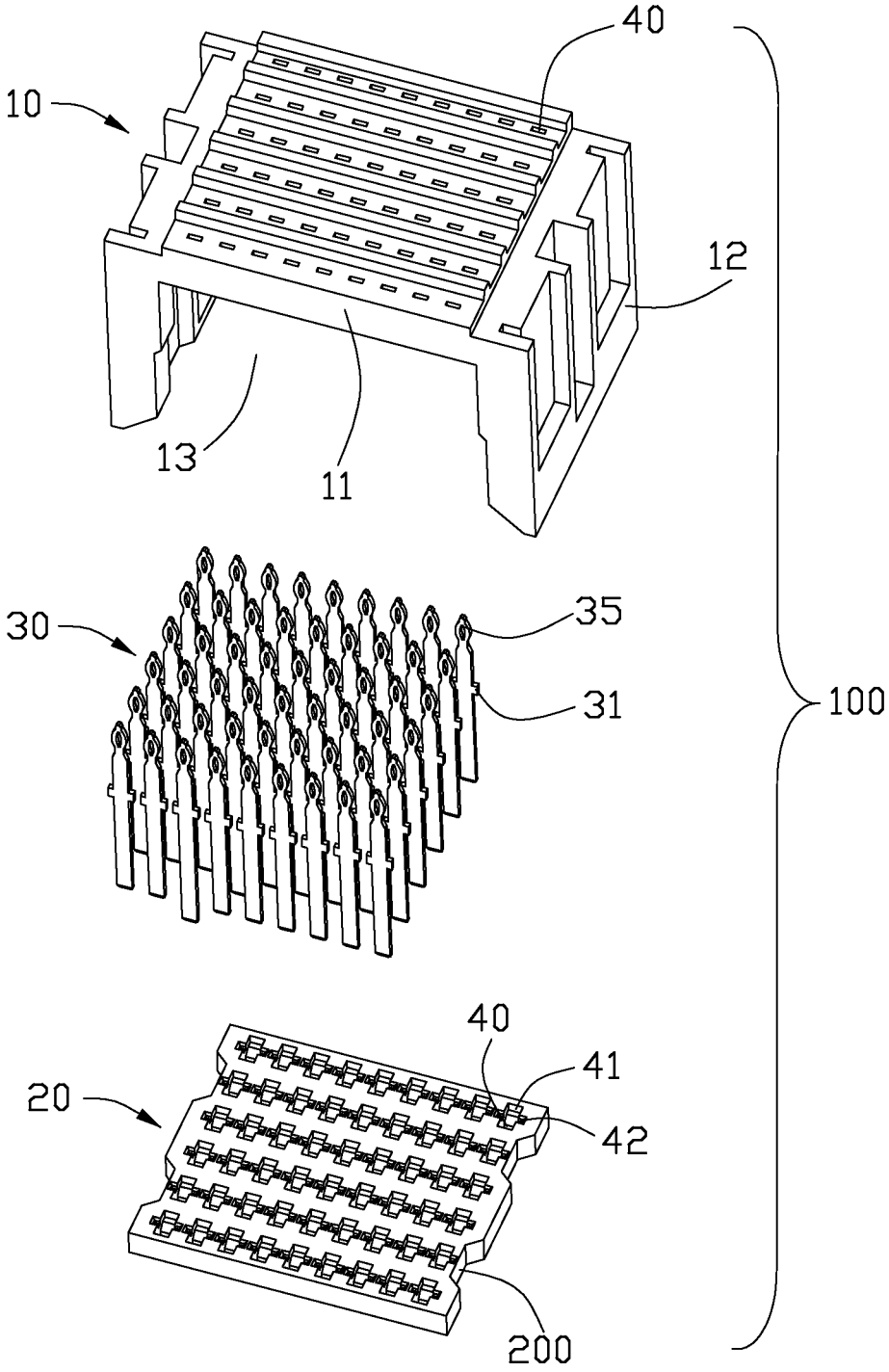
FIG. 3 is a view similar to FIG. 2, taken from another aspect.

Referring to FIGS. 1 to 3, an electrical connector 100 in accordance with the present invention includes a housing (not labeled) having a base 10 and a stiffener 20, and a plurality of contacts 30 inserted in the housing.

The base 10 includes a bottom wall 11, a pair of side walls 12 rising from the bottom wall 11, and a cavity 13 defined between the pair of side walls 12. Each side wall 12 defines a pair of first indentations 120 facing the cavity 13.

Figure 6:
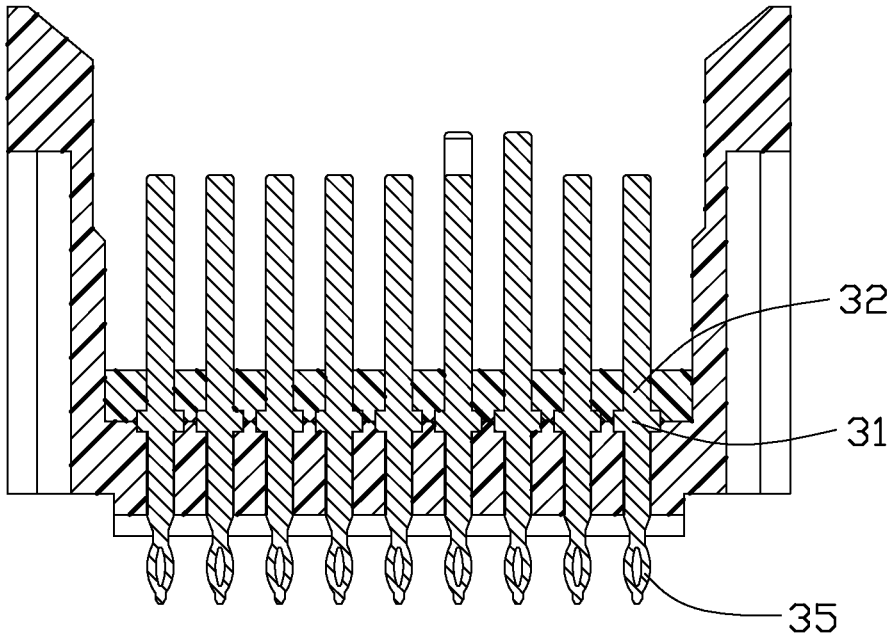
FIG. 6 is a cross-sectional view showing the electrical connector, taken along line 6-6 of FIG. 1.
Figure 7:
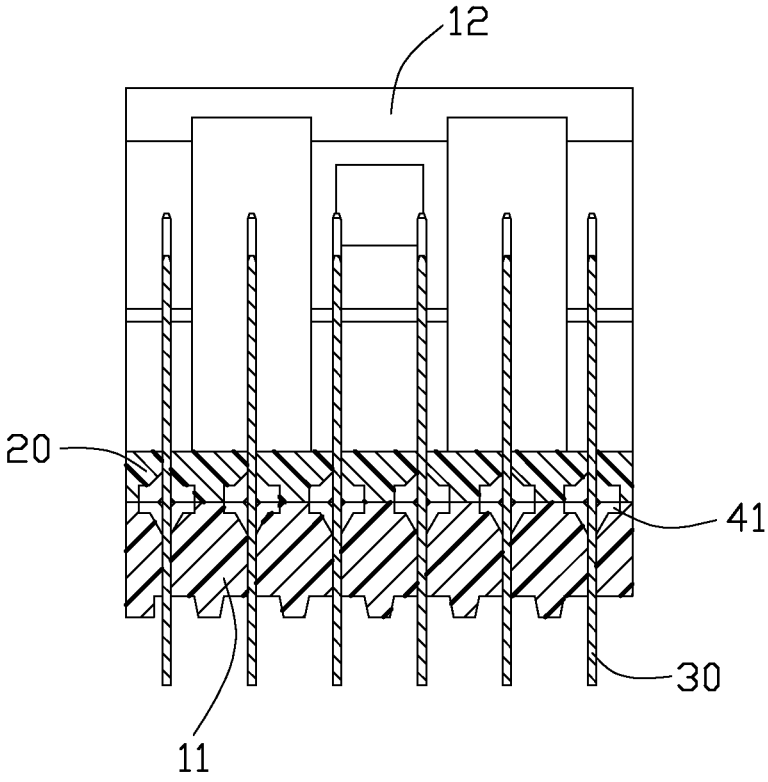
FIG. 7 is a cross-sectional view showing the electrical connector, taken along line 7-7 of FIG. 1.

In conjunction with FIGS. 6 and 7, the bottom wall 11 defines a plurality of passageways 40 extending therethrough along a thickness direction thereof, a plurality of securing recesses 42 each across and open upwardly in communication with an associated passageway 40, and a plurality of air pockets 41 each across and in alignment with the associated passageway 40 along a length direction thereof. Each air pocket 41 defined in the bottom wall 11 extends obliquely downwardly into a deeper level.

Figure 4:
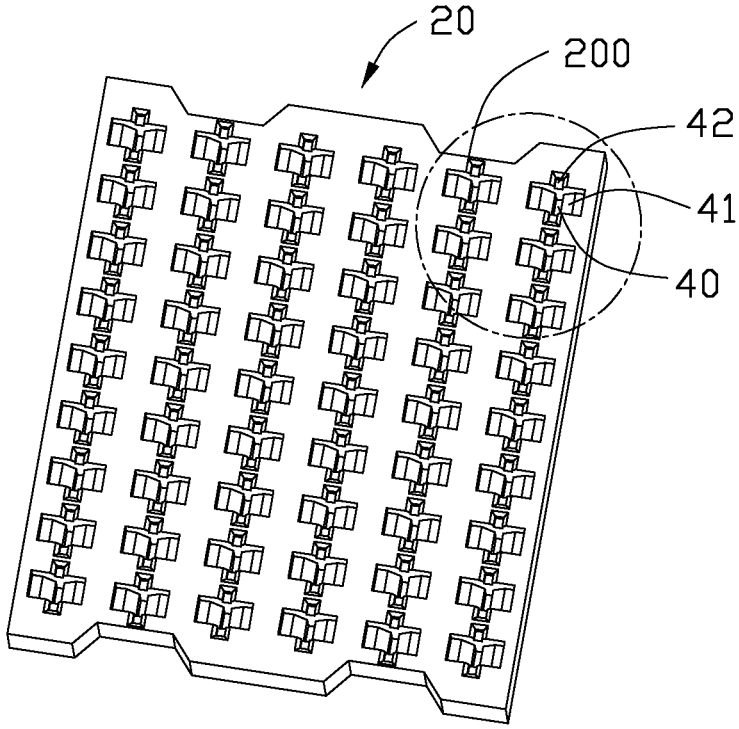
FIG. 4 is a perspective view showing a stiffener as shown in FIG. 2.
Figure 5:
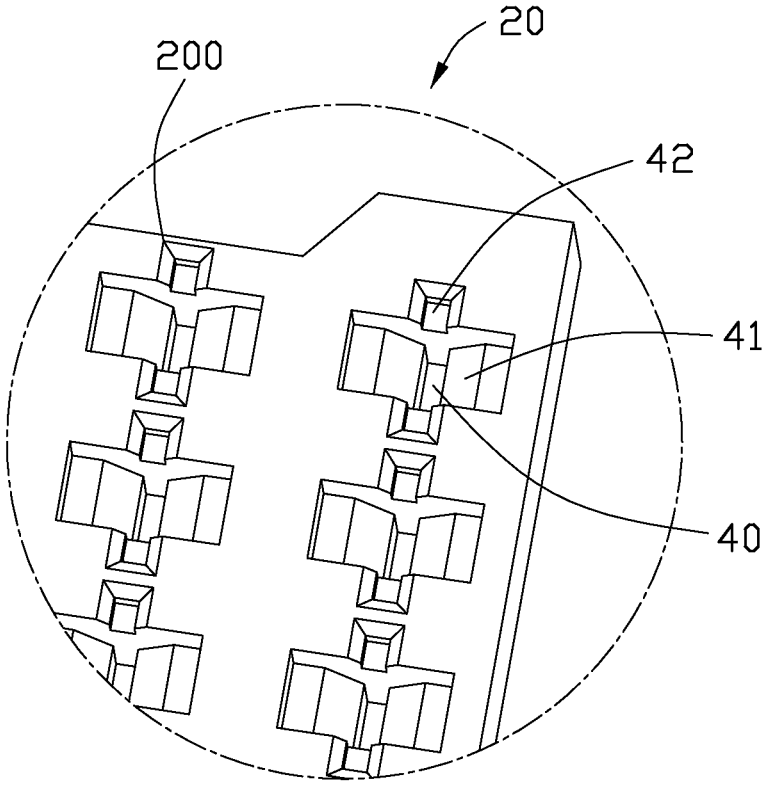
FIG. 5 is an enlarged view showing part of the stiffener as marked in FIG. 4.

In conjunction with FIGS. 3-5, the stiffener 20 defines two pairs of second indentations 200 associated with the two pairs of first indentations 120 for engaging with two pairs of protrusions of a mating connector (not shown). The stiffener 20 defines another plurality of passageways 40 extending therethrough along a thickness direction thereof, another plurality of securing recesses 42 each across and open downwardly in communication with an associated passageway 40, and another plurality of air pockets 41 each across and in alignment with the associated passageway 40 along a length direction thereof. Each air pockets 41 defined in the stiffener 20 extends obliquely upwardly into a deeper level.

Referring to FIGS. 2, 3 and 6, each contact 30 includes a body portion 32, a widen portion 31 formed in the body portion 32 and having a width greater than that of the body portion 32, and a tail portion 35 having a press-fit configuration.

Referring to FIGS. 1-7, in assembling of the electrical connector 100, the stiffener 20 is disposed on the bottom wall 11 of the base 10. The plurality of contact 30 are inserted through the passageways 40 defined in the stiffener 20 and passageways 40 defined in the base 10 along the thickness direction. The widen portion 31 of each contact 30 is partially secured in the securing recess 42 defined in the bottom wall 11 and partially secured in an associated securing recess 42 defined in the stiffener 20, along the width direction. The widen portion 31 of each contact 30 faces to the air pocket 41 defined in the bottom wall 11 and an associated air pocket 41 defined in the stiffener 20, to improve an impedance of the contact 30 by air in the air pockets 41. The tail portion 35 of each contact 30 is exposed outwardly of the base 10.

In this embodiment, the stiffener 20 is mounted on the base 10 to form a strengthened housing. The bottom wall 11 and the estiffener 20 are combined into a securing structure. The air pockets 41 are defined both in the bottom wall 11 and the stiffener 20. Optionally, the air pockets 41 could be defined in either the bottom wall 11 or the stiffener 20.

In another embodiment, the housing consists of the base 10 only. The bottom wall 11 forms a securing structure. The passageways 40, the securing recesses 42 and the air pockets 41 are only defined in the bottom wall 11. The widen portion 31 of each contact 30 is substantially completely received in the securing recess 42 of the base 10 for facing the air pocket 41 of the base 10.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a housing having a securing structure, the securing structure defining a plurality of passageways each extending therethrough along a thickness direction thereof, a plurality of securing recesses each across and in communication with a corresponding passageway along a width direction thereof, and a plurality of air pockets each across and in alignment with a corresponding passageway along a length direction thereof; and a plurality of contacts each having a body portion and a widen portion formed in the body portion, said body portion being inserted through the passageway, said widen portion being secured in the securing recess and facing a corresponding air pocket.

2. The electrical connector as claimed in claim 1, wherein said housing includes a pair of side walls rising upwardly from said securing structure, and said plurality of securing recesses open upwardly.

3. The electrical connector as claimed in claim 2, wherein said plurality of air pockets open upwardly.

4. The electrical connector as claimed in claim 1, wherein said securing structure consists of a bottom wall and a stiffener disposed on the bottom wall, said housing including a pair of side walls rising upwardly from said bottom wall, and said plurality of securing recesses are partially defined in the bottom wall and open upwardly, and are partially defined in the stiffener and open downwardly.

5. The electrical connector as claimed in claim 4, wherein said plurality of air pockets are partially defined in the bottom wall and open upwardly, and are partially defined in the stiffener and open downwardly.

6. The electrical connector as claimed in claim 4, wherein said plurality of air pockets are defined in the bottom wall and open upwardly.

7. The electrical connector as claimed in claim 4, wherein said plurality of air pockets are defined in the stiffener and open downwardly.

8. The electrical connector as claimed in claim 4, wherein said widen portion of each contact is partially secured in the securing recess defined in the bottom wall, and is partially secured in an associated securing recess defined in the stiffener.

9. The electrical connector as claimed in claim 4, wherein said side walls and the stiffener respectively define a plurality of indentations for engaging with a plurality of protrusions of a mating connector.

10. The electrical connector as claimed in claim 1, wherein said securing recess and an associated air pocket form a cross shape.

11. The electrical connector as claimed in claim 1, wherein each air pocket extends obliquely into a deeper level.

12. The electrical connector as claimed in claim 1, wherein each contact has a tail portion having a press-fit configuration exposed outwardly of the housing.

13. An electrical connector comprising:

an insulative housing sub-assembly;

a plurality of passageways formed in and extending through said housing sub-assembly in a vertical direction;

a plurality of contacts disposed in the corresponding passageways, respectively, each of said contacts defining a pin type configuration with a rectangular cross-section defining a long side along a first transverse direction perpendicular to said vertical direction, and a short side along a second transverse direction perpendicular to both said vertical direction and the first transverse direction; and a pair of air pockets formed in the housing sub-assembly and communicatively located by two sides of each of the contacts in the second transverse direction; wherein said pair of pockets are isolated from an exterior.

14. The electrical connector as claimed in claim 13, wherein the housing sub-assembly includes a spacer and a housing unit.

15. The electrical connector as claimed in claim 14, wherein said spacer is located in the housing unit in a stacked manner, and the pair of pockets communicate, in the vertical direction, with an interface between the spacer and the housing unit.

16. The electrical connector as claimed in claim 15, wherein each of said air pockets is located in both the spacer and the housing unit.

17. The electrical connector as claimed in claim 13, wherein the contact defines at least one shoulder section in the first transverse direction to confront at least one of the spacer and the housing unit for restricting movement of the contact in the vertical direction.

18. An electrical connector comprising:

an insulative housing sub-assembly including an insulative spacer stacked upon an insulative housing unit;

a plurality of passageways formed in and extending, in a vertical direction, through said housing sub-assembly including both the spacer and the housing unit;

a plurality of contacts disposed in the corresponding passageways, respectively, each of said contacts defining a pin type configuration with a rectangular cross-section defining a long side along a first transverse direction perpendicular to said vertical direction, and a short side along a second transverse direction perpendicular to both said vertical direction and the first transverse direction; and at least one air pocket formed in at least one of the housing unit and the spacer and communicatively located by two sides of each of the contacts in the second transverse direction, and further communicating, in the vertical direction, with an interface between the spacer and the housing unit.

19. The electrical connector as claimed in claim 18, wherein the contact defines two opposite shoulder sections in the vertical direction to respectively confront the spacer and the housing unit so as to prevent up-and-down movement of the contact with regard to the housing sub-assembly in the vertical direction.

20. The electrical connector as claimed in claim 19, wherein the air pocket extends beyond said two opposite shoulder sections in the vertical direction.

* * * * *